US006472805B1

(12) United States Patent
Nakagawa et al.

(10) Patent No.: US 6,472,805 B1
(45) Date of Patent: Oct. 29, 2002

(54) COLOR CATHODE RAY TUBE

(75) Inventors: Shinichiro Nakagawa, Fukaya (JP); Yoshiaki Ito, Fukaya (JP); Takashi Murai, Fukaya (JP); Masatsugu Inoue, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 237 days.

(21) Appl. No.: 09/641,887

(22) Filed: Aug. 18, 2000

(30) Foreign Application Priority Data

Aug. 19, 1999 (JP) ..... 11-232066
Aug. 8, 2000 (JP) ..... 2000-239481

(51) Int. Cl.[7] ..... H01J 29/86
(52) U.S. Cl. ..... 313/402; 313/461; 313/477 R
(58) Field of Search ..... 313/402, 461, 313/477 R, 408

(56) References Cited

U.S. PATENT DOCUMENTS

| | | | |
|---|---|---|---|
| 4,677,339 | A | 6/1987 | Inoue et al. |
| 4,697,119 | A | 9/1987 | Inoue et al. |
| 4,881,004 | A | 11/1989 | Inoue et al. |
| 5,416,379 | A | 5/1995 | Inoue et al. |
| 5,631,520 | A | 5/1997 | Inoue et al. |
| 5,663,610 | A | 9/1997 | Inoue et al. |
| 6,025,676 | A | 2/2000 | Ohama et al. |
| 6,066,914 | A | 5/2000 | Shimizu et al. |

FOREIGN PATENT DOCUMENTS

| | | |
|---|---|---|
| JP | 9-245685 | 9/1997 |
| JP | 10-199436 | 7/1998 |

*Primary Examiner*—Vip Patel
*Assistant Examiner*—Ken A Berck
(74) *Attorney, Agent, or Firm*—Oblon, Spivak, McClelland, Maier & Neustadt, P.C.

(57) ABSTRACT

An effective portion of a panel of a vacuum envelope has a substantially rectangular, nearly flat outer surface, and a phosphor screen is formed on the inner surface of the effective portion. An effective surface of a shadow mask that is opposed to the inner surface of the effective portion is in the form of a curved surface projecting toward the phosphor screen. The effective surface is formed so that there are relations:

$$1 > RV\min/RV\max \geqq 0.3,$$

where RVmin and RVmax are minimum and maximum values, respectively, of the minor-axis-direction curvature radius of the effective surface on the minor axis, and $$1 < RHC/RHA \leqq 3,$$

where RHA is the average major-axis-direction curvature radius of the effective surface on the major axis, and RHC is the major-axis-direction curvature radius in the center of the effective surface.

4 Claims, 3 Drawing Sheets

COLOR CATHODE RAY TUBE

CROSS-REFERENCE TO RELATED APPLICATIONS

This application is based upon and claims the benefit of priority from the prior Japanese Patent Applications No. 11-232066, filed Aug. 19, 1999; and No. 2000-239481, filed Aug. 8, 2000, the entire contents of which are incorporated herein by reference.

BACKGROUND OF THE INVENTION

The present invention relates to a color cathode ray tube, and more particularly, to a color cathode ray tube in which the outer surface of an effective portion of a panel is flattened.

In general, a color cathode ray tube comprises a vacuum envelope that includes a panel, which has a substantially rectangular effective portion, and a funnel bonded to the panel. Formed on the inner surface of the effective portion of the panel is a phosphor screen having three-color phosphor layers, which glow red, blue, and green, individually. A shadow mask having a large number of electron-beam passage apertures is opposed to the phosphor screen. Located in a neck of the funnel, moreover, is an electron gun for emitting three electron beams toward the screen.

In the color cathode ray tube constructed in this manner, the three electron beams emitted from the electron gun are deflected by means of magnetic fields generated by a deflector, which is mounted on the outside of the funnel, and scan the phosphor screen horizontally and vertically through the shadow mask, whereupon a color image is displayed on the screen.

For improved visibility, according to the modern color cathode ray tube of this type, the outer surface the effective portion of the panel tends to be flattened. As the outer surface of the effective portion is flattened in this manner, it is necessary also to flatten the inner surface of the effective portion, and besides, the effective surface of the shadow mask that is opposed to the phosphor screen on the inner surface of the effective portion.

If the conventional shadow mask, having the spherical effective surface, is flattened in a manner such that its curvature radius is simply increased, however, the so-called doming occurs when high-density electron beams are emitted from the electron gun to display a high-brightness image. The doming is a phenomenon that the shadow mask undergoes substantial local thermal expansion and bulges toward the phosphor screen when it is hit by the electron beams. The doming of the shadow mask causes lowering of color purity.

If the shadow mask is flattened, moreover, its strength for curvature retention lowers, so that the mask may be deformed by impact that acts thereon during the manufacture or transportation of the color cathode ray tube. In consequence, the cathode ray tube may possibly be rendered defective.

As means for easing the above problems, a panel is described in Jpn. Pat. Appln. KOKAI Publication No. 9-245685. This panel is designed so that the outer surface of its effective portion is flat, the major-axis-direction curvature radius of the inner surface is substantially infinite, and the minor-axis-direction curvature radius is substantially fixed. Proposed in Jpn. Pat. Appln. KOKAI Publication No. 10-199436, moreover, is a shadow mask of which the effective surface is shaped corresponding to a flattened panel.

The panel and the shadow mask described above ensure certain effects to cope with the aforementioned problems. To improve the visibility of the color cathode ray tube further, however, the inner surface of the effective portion of the panel and the effective surface of the shadow mask should be flattened additionally. The flattened shadow mask requires higher strength for curvature retention and a securer measure to counter doming.

BRIEF SUMMARY OF THE INVENTION

The present invention has been contrived in consideration of these circumstances, and its object is to provide a color cathode ray tube with improved visibility, in which the strength of a shadow mask for curvature retention is improved and doming is reduced.

In order to achieve the above object, a color cathode ray tube according to the present invention comprises: an envelope including a panel with a substantially rectangular effective portion having a substantially flat outer surface and a funnel bonded to the panel; a phosphor screen on the inner surface of the effective portion; a shadow mask having a substantially rectangular effective surface opposed to the phosphor screen and formed with a large number of electron-beam passage apertures, the effective surface being a curved surface projecting toward the phosphor screen; and an electron gun located in a neck of the funnel, for emitting electron beams toward the phosphor screen, the shadow mask and the panel sharing a center through which a tube axis passes and major and minor axes passing through the center and extending at right angles to the tube axis and to each other, the shadow mask being formed so that there are relations:

$$1 > RV\min/RV\max \geqq 0.3,$$

where RVmin and RVmax are minimum and maximum values, respectively, of the minor-axis-direction curvature radius of the effective surface on the minor axis, and $$1 < RHC/RHA \leqq 3,$$

where H is the distance between the opposite ends of the effective surface in the direction of the major axis, RHA is the average major-axis-direction curvature radius of the effective surface on the major axis, defined by H/2 and a depression zH of each major-axis end of the effective surface in the direction of the tube axis, compared to the center of the effective surface, and RHC is the major-axis-direction curvature radius in the center of the effective surface.

According to the color cathode ray tube of the invention, the minor-axis-direction curvature radius of the effective surface of the shadow mask on the minor axis gradually decreases from the center of the effective surface toward the minor axis end.

According to the color cathode ray tube of the invention, moreover, the major-axis-direction curvature radius of the effective surface of the shadow mask on the major axis gradually decreases from the center of the effective surface toward the major axis end.

According to the color cathode ray tube constructed in this manner, the strength of the shadow mask for curvature retention can be improved, and doming can be reduced. Further, the depression of the peripheral portion of the effective surface of the shadow mask in the direction of the tube axis is reduced, and therefore, the depression of the peripheral portion of the inner surface of the panel in the tube axis direction is reduced. Thus, the outer surface of the effective portion of the panel is flattened, and the difference in wall thickness between the central portion and the peripheral edge portion of the effective portion is reduced, so that the visibility can be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to an embodiment of the present invention will now be described in detail with reference to the accompanying drawings.

Figure 1:
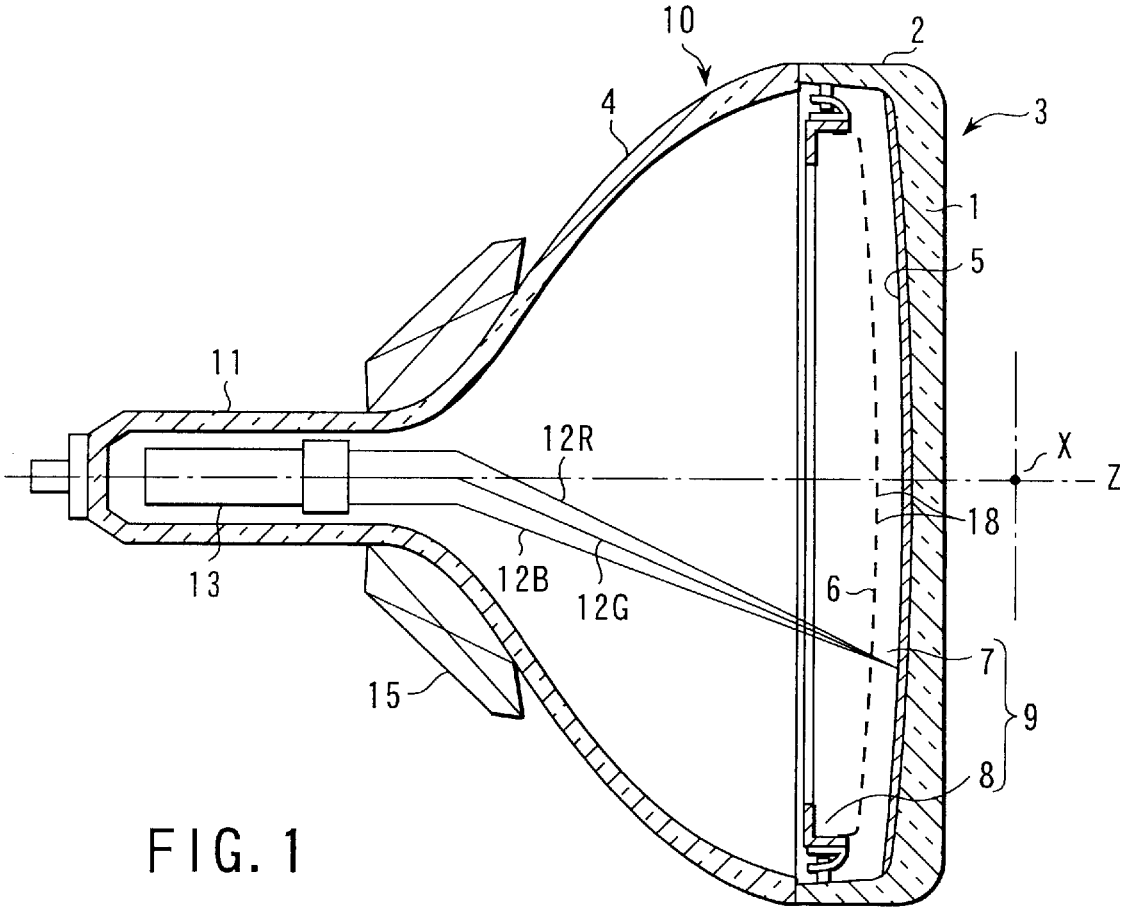
FIG. 1 is a sectional view showing a color cathode ray tube according to an embodiment of the present invention.

As shown in FIG. 1, the color cathode ray tube comprises a vacuum envelope 10 that is formed of glass. The vacuum envelope includes a panel 3, which has a substantially rectangular effective portion 1 and a skirt portion 2 set up on the peripheral edge of the effective portion, and a funnel 4 that is bonded to the skirt portion. Formed on the inner surface of the effective portion 1 is a phosphor screen 5 having three-color phosphor layers, which glow red, blue, and green, individually, and black light absorbing layers.

The vacuum envelope 10 contains a shadow mask 9 that is opposed to the phosphor screen 5. The mask 9 is provided with a substantially rectangular mask body 7 and a mask frame 8 that supports the peripheral edge portion of the mask body. The mask body 7 has a rectangular effective surface 6 that is opposed to the screen 5. A large number of electron-beam passage apertures 18 are formed in the effective surface. Located in a neck 11 of the funnel 4, moreover, is an electron gun 13 that emits three electron beams 12R, 12G and 12B toward the screen 5.

The effective portion 1 of the panel 3 and the mask body 7 of the shadow mask 9 share a center through which a tube axis Z passes, a major axis (horizontal axis) X that passes through the center and extends at right angles to the tube axis, and a minor axis (vertical axis) Y that passes through the center and extends at right angles to the major axis.

In the color cathode ray tube constructed in this manner, the three electron beams 12R, 12G and 12B emitted from the electron gun 13 are deflected by means of magnetic fields generated by a deflector 15, which is mounted on the outside of the funnel 4, and scan the phosphor screen 5 horizontally and vertically through the shadow mask 9, whereupon a color image is displayed on the screen.

For improved visibility, according to the present embodiment, the effective portion 1 of the panel 3 is flattened. The outer surface of the effective portion 1 has the form of a flat surface with an average curvature radius of 10,000 mm or more in the diagonal direction or a curved surface with some curvature. The inner surface of the effective portion 1 is in the form of a curved surface that corresponds to the effective surface 6 of the mask body 7, which will be described below.

The following is a detailed description of the shape of the effective surface 6 of the mask body 7. The effective surface 6 is in the form of a curved surface that projects toward the phosphor screen 5. If the minimum and maximum values of a minor-axis-direction curvature radius RV on the minor axis Y of the effective surface 6 are RVmin and RVmax, respectively, the surface 6 is formed so that RVmin and RVmax are given by $$1>RV\min/RV\max \geqq 0.3.$$

Figure 2:
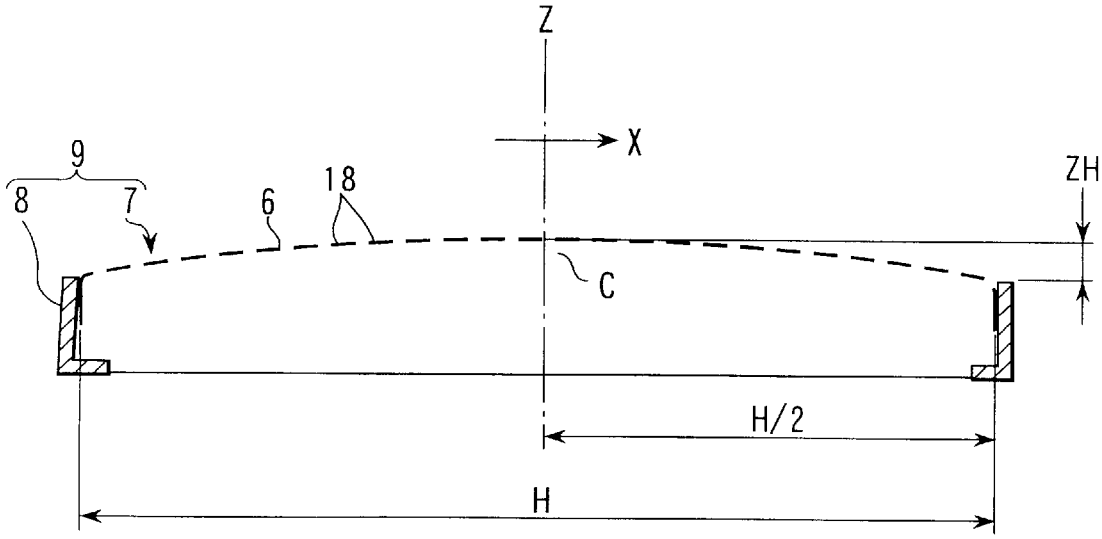
FIG. 2 is a sectional view showing a shadow mask of the color cathode ray tube.

If the distance between the opposite ends of the effective surface 6 in the direction of the major axis X of the effective surface 6 and the depression of each major-axis end of the effective surface in the direction of the tube axis Z, compared to a center C of the effective surface, are H and zH, respectively, as shown in FIG. 2, moreover, the average major-axis-direction curvature radius RHA on the major axis X is given by $$RHA=\{zH^2+(H/2)^2\}/2\cdot zH.$$

If the major-axis-direction curvature radius in the center C of the effective surface is RHC, furthermore, the effective surface 6 is formed so that there are relations:

$$1<RHC/RHA \leqq 3.$$

On the effective surface 6 of the shadow mask 9, moreover, the minor-axis-direction curvature radius RV on the minor axis Y preferably monotonously decreases from the center C of the effective surface 6 toward the minor axis end, and the major-axis-direction curvature radius on the major axis X also monotonously decreases from the center of the effective surface toward the major axis end. The monotonous decrease implies an inconstant gradual reduction that involves transitory increase.

In the case of the shadow mask 9 constructed in this manner, the strength of the effective surface 6 for curvature retention can be enhanced and doming can be reduced even if the effective surface is further flattened. moreover, the inner surface of the effective portion 1 of the panel 3 can be additionally flattened corresponding to the mask 9. In consequence, the difference in wall thickness between the central portion and the peripheral edge portion of the effective portion 1 can be reduced, so that the resulting color cathode ray tube can enjoy improved visibility.

The following is a description of an Example of the shadow mask 9.

EXAMPLE

Figure 3:
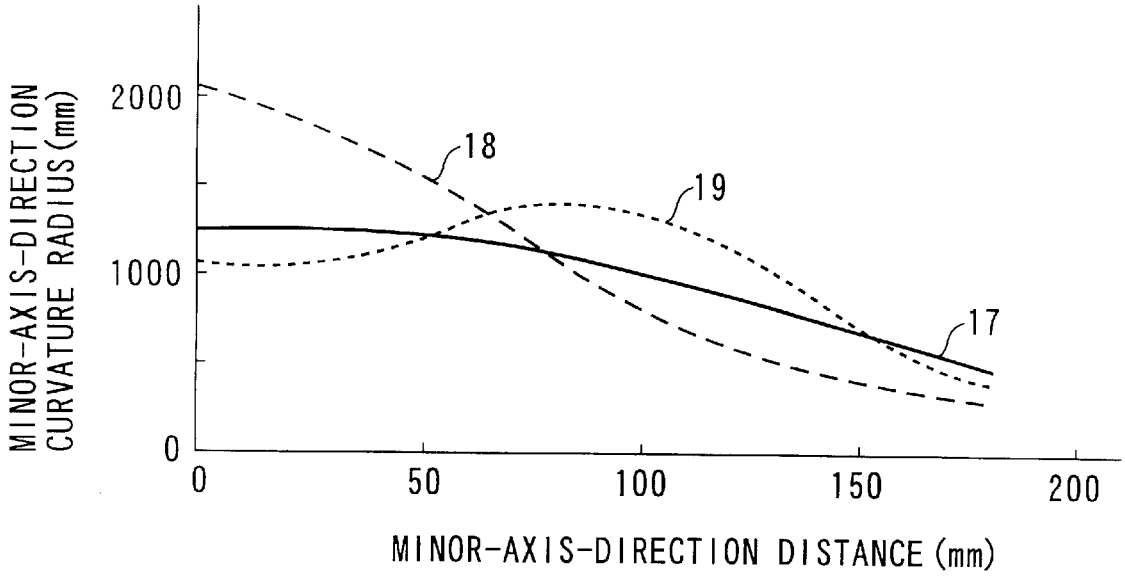
FIG. 3 is a graph showing the minor-axis-direction curvature radius of a shadow mask of the color cathode ray tube of FIG. 1 on its minor axis, compared to that of a shadow mask of another color cathode ray tube.

FIG. 3 shows the minor-axis-direction curvature radius on the minor axis Y of the effective surface 6 for each of shadow masks 9 of three types that are applied to a presently prevailing color cathode ray tube in which the aspect ratio and diagonal dimensions of the effective portion 1 of the panel 3 are 16:9 and 76 cm, respectively. A curved line 17 represents the minor-axis-direction curvature radius of a shadow mask (a) based on this Example. Curved lines 18 and 19 represent the minor-axis-direction curvature radii of shadow masks (b) and (c) as comparative examples, respectively. The shadow mask (b) has a large difference between the minimum and maximum values RVmin and RVmax of the minor-axis-direction curvature radius on the minor axis. The change of the minor-axis-direction curvature radius of the shadow mask (c) is not monotonous.

The shadow mask (a) of this Example is based on RVmin/RVmax=467 mm/1,243 mm=0.38, the shadow mask (b) on RVmin/RVmax=252 mm/2,055 mm=0.12, and the shadow mask (c) on RVmin/RVmax=351 mm/ 1,380 mm=0.25.

In any of these shadow masks, the minor-axis-direction curvature radius of the effective surface 6 in its center C is about 1.7 times as large as the average major-axis-direction curvature radius.

A simulation was tried for the three shadow masks (a), (b) and (c) such that a load (pressure) was applied to the whole effective surface 6 to deform the shadow mask. Loads at buckling points that caused substantial deformation of the curved surface were used as indexes of the strength of the shadow masks for curvature retention.

TABLE 1 below shows loads at the buckling points of the three shadow masks (a), (b) and (c), obtained as relative values with use of a threshold value of 50 Pa as a reference value, 100, at which deformation of the shadow masks starts frequently to occur during the manufacturing processes for color cathode ray tubes.

TABLE 1

| | RVmin/Rvmax | Load (Relative Value) at Buckling Point |
|---|---|---|
| (a) | 467/1243 (0.38) | 132 |
| (b) | 252/2055 (0.12) | 64 |
| (c) | 351/1380 (0.25) | 84 |

As seen from TABLE 1, the relations between the loads at the buckling points of the shadow masks (a), (b) and (c) resemble the relations between their respective values RVmin/RVmax of the minor-axis-direction curvature radius on the minor axis, that is, there are relations, (a)>(c)>(b). The buckling-point load of the shadow mask (a) of the Example, in particular, is about twice as heavy as that of the shadow mask (b), which indicates that the strength of the shadow mask (a) for curvature retention is improved considerably.

Figure 4:
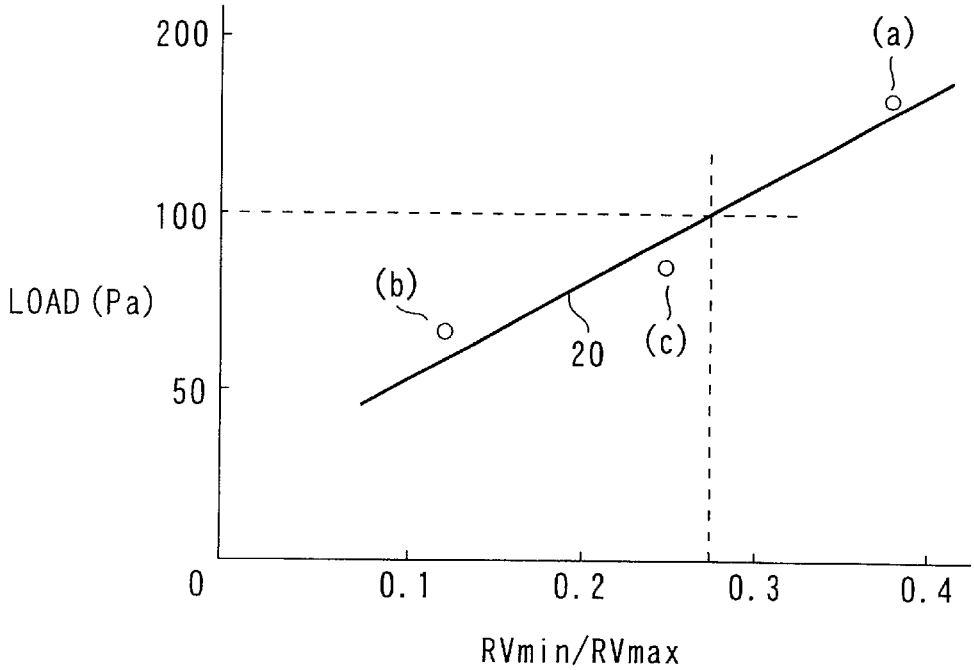
FIG. 4 is a graph showing the relation between the buckling strength and the ratio between minimum and maximum values of the minor-axis-direction curvature radius of the shadow mask on the minor axis.

As shown in FIG. 4, 0.275 is obtained as the value of RVmin/RVmax for the reference value 100 according to an approximate line 20 for the loads at the buckling points of the three shadow masks (a), (b) and (c). Based on this value, a reference value of RVmin/RVmax for satisfactory strength for curvature retention is given as follows:

$$RV\text{min}/RV\text{max} \geqq 0.3.$$

Thus, a shadow mask with greatly improved strength for curvature retention can be obtained if RVmin/RVmax of the minor-axis-direction curvature radius on the minor axis is adjusted to 0.3 or more. If the effective surface of the shadow mask is spherical, in this case, the minor-axis-direction curvature radius at an intermediate portion on the major axis increases, although the strength for curvature retention improves. If local doming occurs, therefore, the landing movement of electron beams increases. Accordingly, RVmin/RVmax should be set as follows:

$$1 > RV\text{min}/RV\text{max} \geqq 0.3.$$

Figure 5:
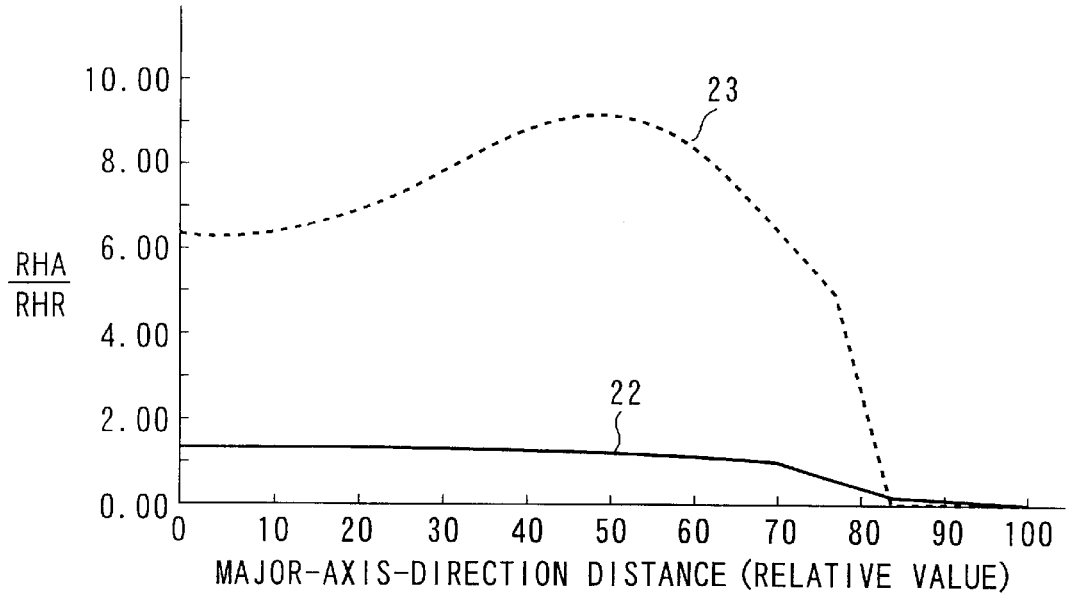
FIG. 5 is a graph showing the relation between the major-axis-direction curvature radius of the shadow mask in the center of its effective surface and the average major-axis-direction curvature radius on the major axis.

FIG. 5 shows the major-axis-direction curvature radius on the major axis of the effective surface of each of two shadow masks that have substantially the same value for RVmin/RVmax of the minor-axis-direction curvature radius on the minor axis of the effective surface and different major-axis-direction curvature radii on the major axis. In FIG. 5, moreover, the axis of abscissa represents the distance from the center C of the effective surface, measured along the major axis and given as a relative value compared to 100 for the major axis end, while the axis of ordinate represents the ratio between the average major-axis-direction curvature radius RHA on the major axis and a local major-axis-direction curvature radius RHR on the major axis.

A curved line 22 represents the shape of the effective surface of the shadow mask (a) of this Example and indicates $$RV\text{min}/RV\text{max}=467\text{ mm}/1{,}243\text{ mm}=0.38.$$

Further, the ratio between the major-axis-direction curvature radius RHC in the center of the effective surface and the average major-axis-direction curvature radius RHA on the major axis is given by $$RHC/RHA=1.7.$$

On the other hand, a curved line 23 represents the shape of the effective surface of a shadow mask (d), a comparative example, and indicates $$RV\text{min}/RV\text{max}=425\text{ mm}/1{,}205\text{ mm}=0.35, \text{ and}$$

$$RHC/RHA=9.7.$$

A simulation was tried for the two shadow masks (a) and (d) such that a load was applied to the whole effective surface to deform the shadow mask. As in the cases of the shadow masks of the aforesaid three types, loads at buckling points were obtained with use of a threshold value of 50 Pa as a reference value, 100, at which deformation of the shadow masks starts frequently to occur during manufacturing processes for color cathode ray tubes. TABLE 2 below shows the result of this simulation.

TABLE 2

| | RHC/RHA | Rvmin/RVmax | Load (Relative Value) at Buckling Point |
|---|---|---|---|
| (a) | 1.7 | 467/1243 (0.38) | 132 |
| (d) | 9.7 | 425/1205 (0.35) | 82 |

Even in the case where RVmin/RVmax≧0.3 is given, the strength for curvature retention lowers if RHC/RHA is large.

The results of tests based on the tubes with different sizes, besides the result of the simulation, indicate that the strength of each shadow mask for curvature retention is lower than the reference value if RHC/RHA<3 is not fulfilled.

Figure 6:
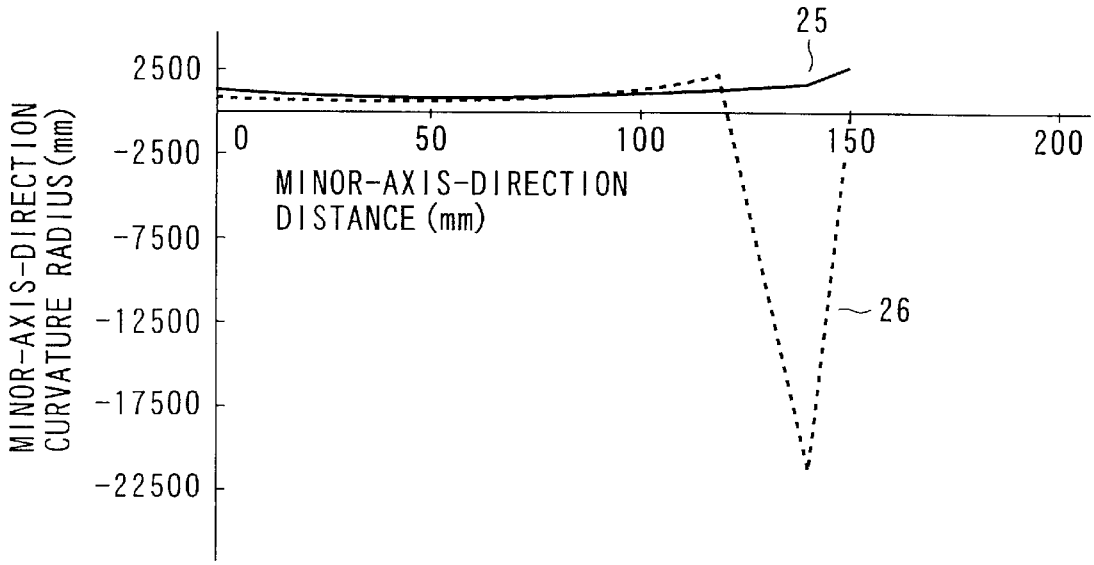
FIG. 6 is a graph showing the relation between the minor-axis-direction curvature radius of the shadow mask on the minor axis and the strength for curvature retention.

FIG. 6 shows the minor-axis-direction curvature radius on the minor axis of the effective surface for each of shadow masks of two types that are applied to a color cathode ray tube in which the aspect ratio and diagonal dimensions of the effective portion of the panel are 16:9 and 66 cm, respectively. In FIG. 6, a curved line 25 corresponds to a shadow mask (e) in which the maximum value RVmax of the minor-axis-direction curvature radius on the minor axis is at the minor axis end, while a curve 26 corresponds to a shadow mask (f) that is curved in the opposite direction (toward the electron gun) near the minor axis end with the sign of RVmin/RVmax inverted.

The shadow masks (e) and (f) are based on $$RV\text{min}/RV\text{max}=711\text{ mm}/2{,}367\text{ mm}=0.3 \text{ and } RV\text{min}/RV\text{max}=-20{,}962\text{ mm}/1{,}427\text{ mm}=-1.47, \text{ respectively.}$$

In any of these shadow masks, the minor-axis-direction curvature radius of the effective surface 6 in its center C is about 1.3 times as large as the average major-axis-direction curvature radius.

A simulation was tried for the two shadow masks (e) and (f) such that a load (pressure) was applied to the whole effective surface to deform the shadow mask. Loads at buckling points were obtained as relative values with use of a threshold value of 50 Pa as a reference value, 100, at which deformation of the shadow masks starts frequently to occur during the manufacturing processes for color cathode ray tubes. TABLE 3 below shows the result of this simulation.

TABLE 3

| | RVmin/Rvmax | Load (Relative Value) at Buckling Point |
|---|---|---|
| (e) | 711/2367 (0.3) | 180 |
| (f) | −20962/1427 (−1.47) | 86 |

In the case of the shadow mask (e) represented by the curved line 25, as seen from TABLE 3, the strength for curvature retention lowers considerably if RVmin/RVmax<0 is given.

Thus, the strength of the shadow mask for curvature retention can be enhanced and doming can be reduced if the effective surface of the mask is formed so that there are relations:

$$1>RV\text{min}/RV\text{max}\geqq 0.3, \text{ and}$$

$$1<RHC/RHA\leqq 3.$$

With use of the shadow mask constructed in this manner, the outer and inner surfaces of the effective portion of the panel can be flattened so that the difference in wall thickness between the central and peripheral portions of the effective portion is reduced. Thus, the resulting color cathode ray tube can enjoy further improved visibility.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel with a substantially rectangular effective portion having a substantially flat outer surface and a funnel bonded to the panel;

a phosphor screen on the inner surface of the effective portion;

a shadow mask having a substantially rectangular effective surface opposed to the phosphor screen and formed with a large number of electron-beam passage apertures, the effective surface being a curved surface projecting toward the phosphor screen; and an electron gun located in a neck of the funnel, for emitting electron beams toward the phosphor screen, the shadow mask and the panel sharing a center through which a tube axis passes and major and minor axes passing through the center and extending at right angles to the tube axis and to each other, the shadow mask being formed so that there are relations:

$$1>RV\text{min}/RV\text{max}\geqq 0.3,$$

where RVmin and RVmax are minimum and maximum values, respectively, of the minor-axis-direction curvature radius of the effective surface on the minor axis, and $$1<RHC/RHA\leqq 3,$$

where H is the distance between the opposite ends of the effective surface in the direction of the major axis, RHA is the average major-axis-direction curvature radius of the effective surface on the major axis, defined by H/2 and a depression zH of each major-axis end of the effective surface in the direction of the tube axis, compared to the center of the effective surface, and RHC is the major-axis-direction curvature radius in the center of the effective surface.

2. A color cathode ray tube according to claim 1, wherein the minor-axis-direction curvature radius of the effective surface of the shadow mask on the minor axis gradually decreases from the center of the effective surface toward the minor axis end.

3. A color cathode ray tube according to claim 1, wherein the major-axis-direction curvature radius of the effective surface of the shadow mask on the major axis gradually decreases from the center of the effective surface toward the major axis end.

4. A color cathode ray tube according to claim 1, wherein the minor-axis-direction curvature radius of the effective surface of the shadow mask on the minor axis gradually decreases from the center of the effective surface toward the minor axis end, and the major-axis-direction curvature radius of the effective surface of the shadow mask on the major axis gradually decreases from the center of the effective surface toward the major axis end.

* * * * *